United States Patent [19]

Schnurer

[11] Patent Number: 4,612,878

[45] Date of Patent: Sep. 23, 1986

[54] WOOD-BURNING HEATER FOR CIRCULATING WATER

[75] Inventor: John W. Schnurer, Doyle Township, Schoolcraft County, Mich.

[73] Assignee: Ralph H. Hoover, Gulliver, Mich. ; a part interest

[21] Appl. No.: 726,458

[22] Filed: Apr. 24, 1985

[51] Int. Cl.[4] ..... F22B 5/00; F23B 7/00; F24D 9/00; F24B 9/04

[52] U.S. Cl. ..... 122/15; 126/101; 126/132; 110/234; 237/56

[58] Field of Search ..... 126/101, 132, 133, 130, 126/5, 53, 54, 34; 237/56, 62; 110/234; 122/15

[56] References Cited

U.S. PATENT DOCUMENTS

| | | | |
|---|---|---|---|
| 361,380 | 4/1887 | Thayer | 237/56 X |
| 1,740,996 | 12/1929 | Muir | 126/121 |
| 2,533,508 | 12/1950 | Riu | 126/101 |
| 3,688,839 | 9/1972 | Kirschner | 126/362 X |
| 4,201,185 | 5/1980 | Black | 126/83 X |
| 4,461,242 | 7/1984 | Black | 126/132 X |

*Primary Examiner*—Larry Jones

*Attorney, Agent, or Firm*—Flynn, Thiel, Boutell & Tanis

[57] ABSTRACT

An improved wood burning furnace having a water preheat chamber connected thereto with a water distribution means in said preheat chamber, said distribution means extending laterally across the preheat chamber and being provided with a plurality of spaced holes for the gravity feed of water downwardly through the chamber. As the water enters the boiler chamber, it flows through a serpentine path thus enhancing the heat transfer to the water.

5 Claims, 5 Drawing Figures

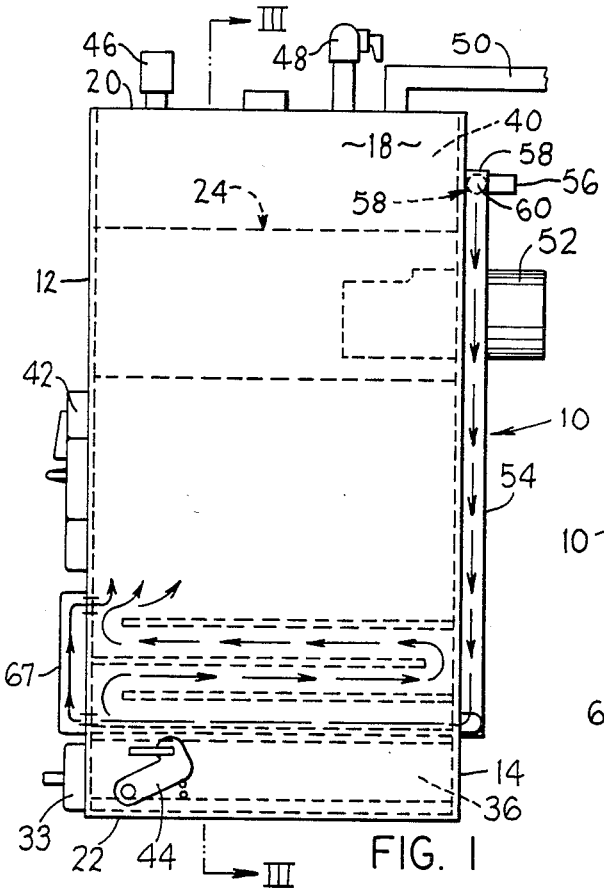
FIG. 1
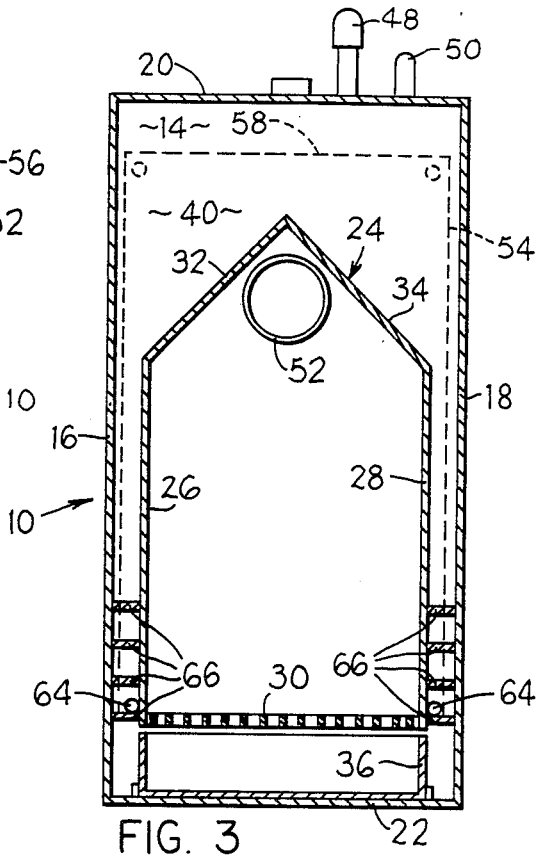
FIG. 3
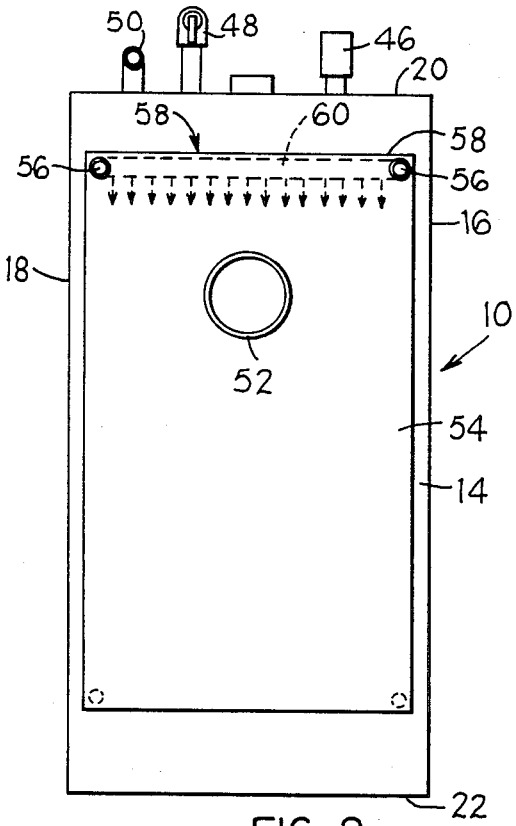
FIG. 2
FIG. 4
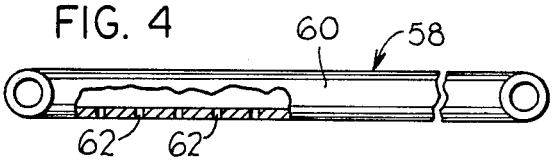
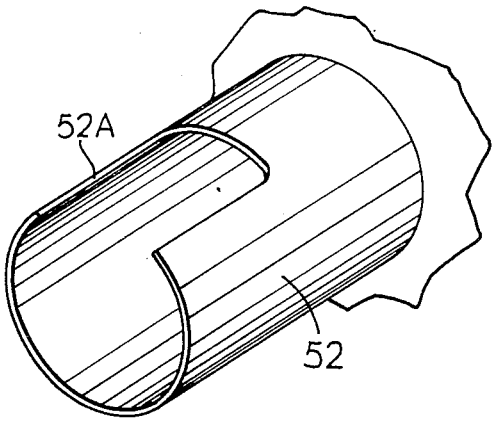
FIG. 5

WOOD-BURNING HEATER FOR CIRCULATING WATER

BACKGROUND OF THE INVENTION

1. Field of the Invention

This invention relates to improvements in wood-burning heaters or furnaces for heating circulating water. Such furnaces are well known in the art and generally comprise a furnace housing with a firebox therein and defining therebetween a water-heating chamber into which relatively cool water is introduced and from which heated water is removed.

2. Description of Related Art

U.S. Pat. No. 4,461,242, issued July 24, 1984, describes a wood-burning furnace for heating water comprising, in addition to the furnace housing and a firebox therein, a water-heating chamber around the rear, top and opposite side walls of the firebox. According to the patent, relatively cool water is pumped into the rear portion of the water-heating chamber and is forced upwardly and forwardly through the chamber to the water outlet located at the top of the furnace. A plurality of openings 43 are provided for the circulation of water between the rear zone 37 and the forward circulation zone of the water-heating chamber. The openings 43 are spaced around the partition wall 35.

SUMMARY OF THE INVENTION

The furnace of this invention comprises a housing having front, back, side, top and bottom walls, and a firebox therein having side walls joined to the front and rear walls of the furnace housing. The side walls of the firebox are spaced inwardly of the side walls of the furnace housing and define a boiler chamber for heating water. A grate defines the bottom wall of the firebox and is spaced above the bottom wall of the furnace housing. The top wall of the firebox is formed of a pair of angled wall members to define a gable with the side walls thereof. The sloping or angled wall members direct the heated gaseous products of combustion into the apex of the gable. A flue pipe extends into the firebox closely adjacent to the apex for exhausting combustion gases from the firebox. The flue pipe is partially cut away at its top within the firebox, so that some of the combustible material in the combustion gas is further burned therein, thus improving the efficiency of the combustion process and minimizing creosote deposit in the flue. The furnace housing and the firebox are constructed of suitable sheet metal, like conventional wood-burning furnaces.

The furnace is constructed with the usual doors for access to the interior of the firebox, so that wood can be placed on the grate. An ash pan is provided below the grate for the collection of ash. A lower door is provided for the removal of the ash pan when necessary to empty it of ash. As is conventional, the grate is constructed of a material, such as cast iron, suitable for its intended use.

A water preheat chamber comprising an auxiliary jacket having top, bottom, side and rear walls is mounted on the rear wall of the firebox, so as to be in heat transfer relationship therewith. Water is introduced into the top portion of the preheat chamber to flow downwardly therethrough and thence into the lower portion of the boiler chamber. For this purpose, a water distribution means in the form of a horizontally extending pipe is located in the upper region of the preheat chamber and is connected to a water source, such as the return circulating water from a residential, hot water, heating system. The water distribution pipe is provided with a plurality of spaced holes, so that water can drip or flow therethrough downwardly into the preheat chamber. Some of the water, in its downward flow, flows around and past a portion of the flue pipe which passes through the preheat chamber, thereby picking up heat from the flue pipe, and thus reducing the temperature of the combustion gases discharged into the stack.

Suitable openings through the rear wall of the furnace and located laterally of the firebox provide the means by which preheated water flows into the lower portion of the boiler chamber. The water then flows along a serpentine path to the upper portion of the boiler chamber. The serpentine path is provided by baffles joined to the facing side walls of the furnace housing and the firebox. The baffles are constructed of metal plates arranged in a manner to provide the desired path. They are located directly laterally of the grate and provide a relatively long flow path for the water to ensure the water being in heat transfer relationship with the wood burning on the grate or with the hot coals thereon for a substantial period of time. A draft control is provided to control the amount of combustion air introduced into the firebox. By controlling the amount of combustion air introduced, it is possible to heat water by the slow-burning coals rather than by flames, thus conserving fuel.

BRIEF DESCRIPTION OF THE DRAWINGS

FIG. 1 is a side view of a furnace and water heater constructed according to this invention;

FIG. 2 is a rear view of the furnace and water heater of FIG. 1;

FIG. 3 is a cross-sectional view taken on line III—III of FIG. 1;

FIG. 4 is a detailed view of the water distribution means of this invention shown in broken lines in FIGS. 1 and 2; and FIG. 5 is a detailed view of the flue pipe shown in FIGS. 1, 2 and 3.

DESCRIPTION OF THE PREFERRED EMBODIMENT

Referring to FIGS. 1 to 3 of the drawing, a furnace 10 is illustrated which comprises a front wall 12, a rear wall 14, side walls 16 and 18, a top wall 20 and a bottom wall 22. Within the furnace is a firebox 24 comprising side walls 26 and 28 spaced inwardly of the side walls 16 and 18 of the furnace 10. The side walls 26 and 28 are joined to the front and rear walls 12 and 14 of the furnace. The bottom of the firebox is defined by a grate 30 spaced above the bottom wall 22. The top of the firebox has sloping or angled wall members 32 and 34 forming a gable which directs gaseous products of combustion into the apex thereof. An ash pan 36 fits below the grate and is accessible through a door 38.

A boiler chamber 40 is defined between the firebox 24 and the side walls 16 and 18 and the top wall 20 of the furnace. Access to the firebox 24 for placing wood on the grate 30 is provided by means of a hinged door 42. A draft control means 44 is provided to adjust the amount of combustion air entering the furnace. The draft control means 44 comprises a pivoted closure plate adapted to selectively close off one or more of the air inlet openings in the side wall 18 below the grate. As usual, the furnace is provided with a temperature gauge 46, a safety valve 48 and a water outlet 50, all located at the top of the furnace. A flue pipe 52 having a cut-away portion 52A, as illustrated in FIG. 5, to provide a partially open top, extends for a distance into the firebox close to the apex thereof. The flue pipe 52 provides a means to exhaust combustion gases from the firebox. Because of its cut-away construction, burning is permitted of some of the combustion gases that would otherwise enter the stack, thus enhancing the efficiency of the furnace and minimizing creosote build-up.

A water preheat chamber 54 is an auxiliary jacket attached to the furnace and in heat transfer relationship with the rear wall of the firebox and the furnace. The water preheat chamber 54 has top, bottom, side and rear walls. The rear wall of the chamber 54 is substantially parallel with and spaced a short distance from the rear-wall 14, of the furnace so that the horizontal thickness of the water preheat chamber is relatively small as appearing in FIG. 1. One or more water inlets 56 are provided adjacent to the top or upper wall 58 of the preheat chamber and are connected to a supply of circulating water at one end and to one or both ends of a water distribution means 58 at their other end. The water distribution means comprises an elongated pipe 60 having a plurality of longitudinally spaced-apart openings or holes 62 therethrough, the details of which are shown in FIG. 4. The water distribution means 58 extends laterally across the upper end of the preheat chamber 54. Water flows downwardly through the holes 62 into and downwardly through the preheat chamber 54, so as to be preheated prior to its entry into the boiler chamber 40. Entry of preheated water into the boiler chamber 40 is through openings 64 in the furnace rear wall. These openings are located laterally of the grate and substantially at the same height. These openings 64 communicate with the lower end of the water preheat chamber and they provide the only water flow paths between the water preheat chamber and the boiler chamber. While it is possible to supply water to the distribution means 58 from one end, it is preferable to do so from both ends, thus ensuring a more even downflow of water therethrough.

A plurality of baffles 66 are joined, as by welds, to the side walls 16, 18 of the furnace and the facing side walls 26, 28 of the firebox and define a serpentine flow path for the preheated water entering the boiler chamber. The baffles 66 are horizontally extending, vertically spaced-apart, parallel plates which can be made of any suitable material such as cast iron or steel. The baffles 66 are located adjacent to and directly laterally of the grate 30 and the zone above the grate that is occupied by the burning wood. The baffles 66 provide a relatively long flow path in heat transfer relationship with the burning wood or hot coals on the grate.

If desired some of the circulating water can be flowed through an auxiliary heat exchanger 67 on the front wall 12 of the furnace to further increase heat recovery.

Preheating the water in the preheat chamber 54 before its entry into the boiler chamber 40 and providing the relatively long flow path for the water entering the boiler chamber materially enhances the efficiency of a wood burning furnace for heating water.

The present invention can be used, for example, to heat the circulating water in a residential, hot water, heating system. It will be effective to heat water more efficiently because the wood will be burned under restricted draft conditions whereby the water will be heated more by coals than by flames. Because of the preheat chamber and the serpentine water flow paths disposed on opposite lateral sides of the grate and fuel present thereon, the circulatory water will be heated substantially to its useful temperature by the time the water exits from the serpentine flow path.

Although the foregoing description has referred to the use of wood as the fuel, it will be evident that other fuels can be used if desired. For example, the fuel can be coal.

The appended claims are intended to cover all reasonable equivalents and are to be construed as broadly as the prior art will permit.

I claim:

1. A wood burning furnace and boiler comprising:

a furnace housing having front and rear walls, opposite side walls, and top and bottom walls;

a firebox within said furnace housing and having a grate and spaced side walls, each firebox side wall being spaced from and facing a side wall of said furnace housing;

a boiler chamber defined between the furnace housing and the firebox, said boiler chamber including an upper portion and two lower portions defined between said facing side walls on opposite sides of said firebox, said lower portions extending downwardly substantially to said grate, the upper ends of said lower portion being joined to said upper portion;

a water preheat chamber comprising an auxiliary jacket connected to the rear wall of said furnace housing in heat transfer relationship therewith, said preheat chamber having an upper wall and a bottom wall;

water inlet and distribution means located adjacent the upper wall of said preheat chamber for flowing water into, downwardly and through the preheat chamber, said water distribution means being positioned laterally across said preheat chamber and having a plurality of spaced holes through which water flows downwardly into said preheat chamber;

inlet openings communicating the lower end of said preheat chamber and the lower ends of said two lower portions of said boiler chamber for the passage of water from said preheat chamber into said lower portions, said inlet openings being located laterally of said grate;

baffle plates joined to the facing side walls of said furnace housing and said firebox in each of said lower portions of said boiler chamber, said baffle plates in each of said lower portions defining an elongated serpentine flow path extending from its associated inlet opening partway toward said upper portion of said boiler chamber so that the water flows through an elongated flow path in each of said lower portions of said boiler chamber and thence into said upper portion of said boiler chamber, said baffle plates being located directly laterally of said grate; and means connected to said upper portion of said boiler chamber for the passage of heated water therefrom.

2. A wood burning furnace as recited in claim 1, wherein said water distribution means comprises a pipe.

3. A wood burning furnace as recited in claim 2, further comprising an exhaust flue pipe adjacent the top of said firebox, said flue pipe having a portion extending into said firebox and passing through said preheat chamber, said flue pipe being so constructed and arranged to burn combustion gases therein.

4. A wood burning furnace as recited in claim 3, in which the top of said firebox comprises a pair of angled walls defining a gable which direct heat into the apex of the gable.

5. A furnace as recited in claim 1 wherein said baffle plates are horizontally extending, vertically spaced-apart plates.

* * * * *